United States Patent [19]

Svoboda et al.

[11] Patent Number: 4,531,758

[45] Date of Patent: Jul. 30, 1985

[54] SKI BINDING

[75] Inventors: Josef Svoboda, Schwechat; Erwin Krob; Helmut Bauer, both of Vienna, all of Austria

[73] Assignee: TMC Corporation, Baar, Switzerland

[21] Appl. No.: 447,830

[22] Filed: Dec. 8, 1982

[30] Foreign Application Priority Data

Dec. 11, 1981 [AT] Austria ..... 5305/81

[51] Int. Cl.[3] ..... A63C 9/084

[52] U.S. Cl. ..... 280/628

[58] Field of Search ..... 280/628, 629, 631, 626

[56] References Cited

U.S. PATENT DOCUMENTS 3,876,219 4/1975 Smolka et al. ..... 280/628
4,421,341 12/1983 Krob et al. ..... 280/628

FOREIGN PATENT DOCUMENTS 2107863 2/1971 Fed. Rep. of Germany ..... 280/626
2347746 5/1974 Fed. Rep. of Germany ..... 280/628
1371727 8/1963 France ..... 280/626

*Primary Examiner*—David M. Mitchell
*Attorney, Agent, or Firm*—Flynn, Thiel, Boutell & Tanis

[57] ABSTRACT

A heel holder includes a base plate mountable on the ski, a sole holder supported for vertical and transverse horizontal movement relative to the base plate, a first locking mechanism for yieldably resisting upward movement of the sole holder away from a closed position adjacent the base plate, and a second locking mechanism which prevents transverse horizontal movement of the sole holder until it has moved upwardly a predetermined distance away from the base plate. The second locking mechanism includes cooperating locking parts on the base plate and the sole holder, one locking part being vertically movably supported on the associated one of the base plate and sole holder and being resiliently urged toward the other locking part. One of the locking parts has a vertical recess which receives the other locking part in the closed position of the sole holder.

11 Claims, 6 Drawing Figures

SKI BINDING

FIELD OF THE INVENTION

This invention relates to a ski binding heel holder and, more particularly, to a heel holder having a sole holder which is supported for vertical and horizontal movement and has a locking element which engages a recess in a cam surface of a locking member to prevent horizontal movement of the sole holder until it has carried out a predetermined amount of vertical movement.

BACKGROUND OF THE INVENTION

A known binding has a sole holder with a first locking element, which sole holder is arranged movably on a support member, wherein the first locking element engages a first locking member which is constructed as a swingably supported cam. The support member is arranged on a base plate for movement in a direction which is approximately at a right angle with respect to the direction of movement of the sole holder. The sole holder also has a second locking element which engages a cam surface on a second locking member which is arranged on the ski, and the cam surface has in its center a recess with vertical surfaces, the distance between these surfaces corresponding approximately with the diameter of the second locking element, the depth of engagement of the locking element in the recess being equal to or greater than the radius of the locking element. This binding is disclosed in Austrian Pat. No. 305 843 (corresponds to U.S. Pat. No. 3,876,219).

Ski bindings which have been produced and sold according to this Austrian patent are very successful. They well meet the purpose of providing a controlled release of the ski boot in response to forces which act simultaneously in the horizontal and vertical directions, whereby for forces which only act in the horizontal direction a lock makes impossible the operation of the heel holder. A horizontal release occurs with the usual heel holders of safety ski bindings only at the front jaw. By determining the height of the vertical surfaces of the cam surface recess, it is possible to make the blocking recess longer or shorter. When the second locking element reaches the upper end of the side surfaces which define the recess, then the so-called controlled diagonal release is started.

The primary goal of the invention is an improvement of the binding which is disclosed in Austrian Pat. No. 305 843 by enlarging the effective height of the blocking recess without actually changing the dimensions of the locking element or the vertical surfaces which define the recess.

SUMMARY OF THE INVENTION

This goal is achieved inventively by one of the locking element which is provided on the sole holder and the locking member which is arranged on the ski being supported resiliently relative to the sole holder or the ski, respectively.

Through this inventive measure, the effective height of the blocking recess is increased, because during a predetermined and relatively small lifting up of the sole holder away from the upper side of the ski, either the second locking element which is provided on the sole holder and biased by the force of a spring still extends into the recess which is defined with the vertical surfaces, or the locking member which is arranged on the ski and is biased by a spring follows the vertical movement of the sole holder. In both cases, an increased effective height for the blocking recess is achieved, without a change of the dimensions of the locking element and/or of the vertical surfaces which define the recess. In addition, the effective enlargement of the blocking recess can be determined by the designer, within a certain range by suitably selecting the spring.

In an advantageous development of the invention, it is provided that a roller which forms the second locking element is supported on an axle which in turn is supported in the sole holder in two slotted holes which extend vertically, and is resiliently biased relative to the sole holder by means of a spring which is secured in the sole holder, for example by means of a pair of leaf springs. Through the resilient support of the roller in its bearing openings, a particularly simple design is given.

An advantageous embodiment of this thought of the invention is characterized by the axle of the roller, viewed in the open position of the heel holder, resting at the lower ends of the two slotted holes and, viewed in the closed condition of the heel holder, being maintained against the force of the two springs in the upper portions of the slotted holes. It is sufficient in this development if each spring is initially tensioned only so far that it is assured that, in the open condition of the heel holder, the axle of the roller assumes the just described lower position.

A still further thought of the invention lies in the second locking member which is supported in a conventional manner on the base plate and is formed by control surfaces on at least one support, if desired on two supports, being vertically adjustably supported relative to the base plate and being biased by a spring, preferably a pair of springs. It is thus possible, for a vertically fixed support of the roller which forms the second locking element, for resilient support of the locking member to occur, whereby through the possibility of the symmetrical support compared with a central support a better force distribution can be achieved.

In a further development of this thought of the invention, two leaf springs are provided as the springs and are arranged between the upper side of the base plate and the underside of two support areas of the locking member, whereby in two downwardly bent side areas of the base plate retainer pins are secured and cooperate with slotted holes which are provided in the support and extend in a vertical direction. In this manner, a simple design of the locking system and at the same time a secure guiding of the resiliently supported structrual parts of the locking arrangement relative to one another is assured.

A further thought of the invention consists in the locking member being a U-shaped member in the top view, the web of which member serves as the locking member support and the two legs of which are each supported pivotally on a respective swivel bolt which is secured on the base plate. In this manner, the locking member can be designed to be particularly stable.

According to a different characteristic of the foregoing further development, the two support areas of the locking member have blind bores, in each of which one end of a respective helical spring lies, whereby the other end of each of these springs is supported on the upper side of the base plate, and whereby the base plate is equipped with two bolts which are arranged symmetrically with respect to the longitudinal axis of the ski and extend in the longitudinal direction of the ski, which bolts are each secured in a respective sheet metal wall which is bent out of the material of the base plate, on each of which bolts is supported pivotally a respective one of the two support parts which have the individual control surfaces. In this manner, a separate guide for the individual support parts on the base plate is not needed, as has been necessary for example according to the preceding embodiment.

BRIEF DESCRIPTION OF THE DRAWINGS

Further characteristics, advantages and details of the invention will now be described in greater detail in connection with the drawing, which illustrates several exemplary embodiments.

In the drawing.

Figure 1:
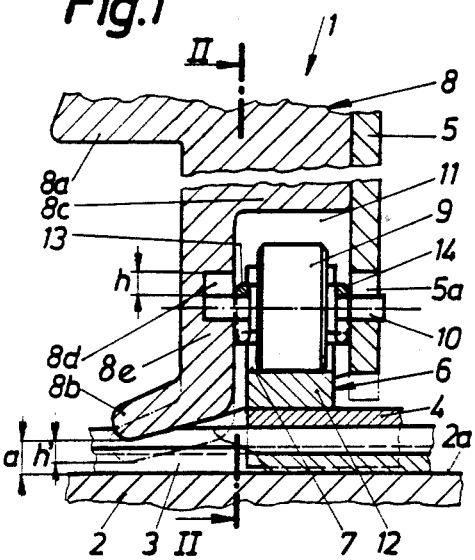
FIG. 1 is a sectional side view of a heel holder embodying the present invention and illustrates details of a resiliently supported locking element cooperable with a locking member arranged on the ski.

In the following description, structural parts with an identical design and function are identified with the same reference numerals, and structural parts which differ in design but have functions which are identical or comparable are identified with the same reference numerals differentiated by one or more primes (').

DETAILED DESCRIPTION

Figure 2:
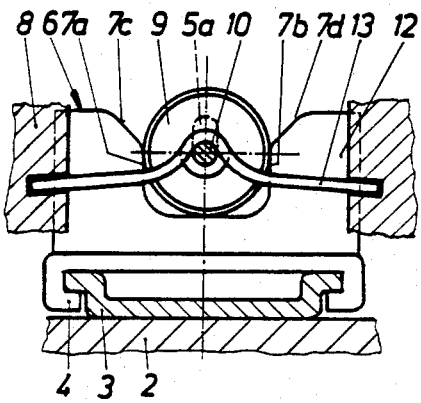
FIG. 2 is a sectional view taken along the line II—II in FIG. 1.
Figure 3:
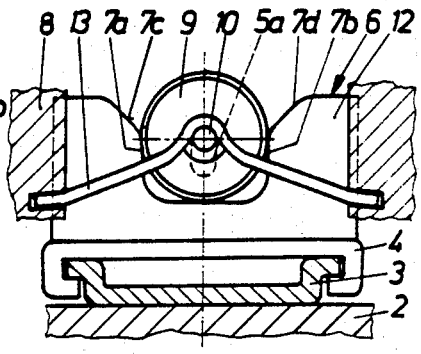
FIG. 3 is a sectional view similar to FIG. 2 in which the sole holder is closed and the resiliently supported locking element engages the locking member.

FIGS. 1 to 3 disclose a heel holder which is similar in some respects to that disclosed in U.S. Pat. No. 3,876,219, the disclosure of which is incorporated herein by reference.

In the exemplary embodiment according to FIGS. 1 and 2, only the part of the heel holder which relates to the actual subject matter of the invention is illustrated. Except for the differences described hereinafter, the heel holder of FIG. 1 is similar to that disclosed in U.S. Pat. No. 3,876,219.

A ski 2 has a ski fixed guide rail 3, and a base plate 4 which is slidably supported on guide rail 3, can be adjusted in the direction of the longitudinal axis of the ski 2 relative to the guide rail 3 and can be locked in a desired position. This type of adjustment is known by itself, and does not form a part of the subject matter of the invention. On the base plate 4 is supported in a conventional manner a support member which is not illustrated and can be pivoted about a pivot pin which stands perpendicular with respect to the base plate 4. A swivel axle which extends transversely with respect to the longitudinal axis of the ski 2 is supported in the support member, about which swivel axle a housing 5 can be pivoted upwardly. Only the front part of the housing 5 is illustrated, on which is held a sole holder 8, as is known by itself. The sole holder 8 is equipped in a conventional manner with a downholding member **8*a* for a ski boot which is not illustrated here and with a mandrel 8*b* which the ski boot can engage for closing the heel holder 1. The portion or wall 8*e* of the sole holder 8 which carries the mandrel 8*b* is offset forwardly relative to the housing 5, so that an inner wall 8*c* on the sole holder 8 is created, the wall 8*e* extending substantially parallel to the front side of the housing 5 and defining therewith a free space or recess 11**.

A locking element which forms a part of the subject matter of the invention is designed in the present case as a roller 9 which is supported by means of an axle 10 in a guideway **8*d* of the sole holder 8, which guideway is designed as a slotted hole, and a further guideway 5*a* of the housing 5, which guideway is also a slotted hole. The two guideways 8*d*, 5*a* extend vertically, and the axle 10 of the roller 9 is urged downwardly therein by means of two springs 13, 14 which are leaf springs in the present case. Thus, the axle 10 normally sits at the lower ends of the two guideways 8*d*, 5*a*. The roller 9 with its axle 10 remains, under the action of the two springs 13, 14, in the described position, until the roller 9 experiences an upwardly acting force which exceeds the force of the two springs 13, 14. Thus, the described position of roller 9 and axle 10 in the open condition of the heel holder 1 and also in its swung-down position is maintained. However, when a ski boot acts onto the mandrel 8*b* of the sole holder 8 and swings the heel holder 1 into the closed position, a force which acts upwardly onto the roller 9** is created, as will be described hereinafter.

The base plate 4 carries, in the region which is below and approximately corresponds in width with the roller 9, a locking member 6. The locking member 6 is secured, for example as a support 12, on the base plate 4, and thus forms a unit with the base plate. It can also be designed of the material of the base plate itself. The support 12 of the locking member 6 has, as one can see from FIG. 2, a control surface 7, on which rests or slides the roller 9 in a manner which will yet be described. The control surface 7 has, viewed in the swung-down position of the sole holder 8, and adjacent to the roller 9, two substantially vertical surfaces **7*a*, 7*b*, and adjacent each of these, an inclined cam surface 7*c*, 7*d*. In the position which is illustrated in FIGS. 1 and 2 there is between the underside of the mandrel 8*b* of the sole holder 8 and the upper side of the guide rail 3 (or of the ski 2**) a distance or clearance a, which is greater than a vertical distance h which will yet be described.

If the sole holder 8 is now closed, for example by the ski boot pressing the mandrel **8*b* into its lowermost position, then the resistance which acts from the control surface 7 onto the roller 9 will effect a movement of the axle 10 upwardly in the two guideways 8*d*, 5*a* against the force of the two springs 13, 14, so that the axle 10 is then disposed in the upper regions of the guideways 8*d*, 5*a*, as shown in FIG. 3. The mandrel 8*b* thereby assumes the position which is illustrated in dashdotted lines in FIG. 1. A similar movement occurs when the sole holder 8** is closed not by the ski boot but manually, for example by operating a known release lever.

The two springs 13, 14 are thereby given a tension greater than their initial tension, so that they always tend to urge the axle 10 of the roller 9 downwardly toward the locking member 6 and the upper side of the ski **2*a*. This urging of the two springs 13, 14 exists constantly in the closed position of the heel holder 1. If, therefore, for example during downhill skiing, forces act onto the ski shoe and urge it upwardly against the down-holding member 8***a* of the sole holder 8 and thus away from the upper side of the ski 2*a*, then during a slight lifting up of the sole holder 8 away from the upper side of the ski 2*a*, the axle 10 and thus the roller 9 are pressed downwardly in the guideways 8*d* and 5*a* by the two springs 13, 14. Relative movement thus occurs between the roller 9 and the two guideways 8*d*, 5*a* of the sole holder 8 and the housing 5, whereby the axle 10 maintains its position relative to the support 12 as the sole holder 8 moves upwardly away from the upper side of the ski. Such a relative movement takes place until the two lower ends of the guideways 8*d*, 5*a* make contact with the axle 10. Until the end of this relative movement, the roller 9 remains in the recess of the control surface 7, which recess is between the two vertical surfaces 7*a*, 7*b*.

The distance which the sole holder 8 can move without the position of the axle 10 changing is given in FIG. 1 as a control distance h. The vertical distance between the swung-down position and the stepped-down position of the mandrel 8*b* of the sole holder 8 is identified h'. The h and h' values are only nominally identical; to avoid a nonpermissible double limiting, one of these parts, preferably the mandrel 8*b*, is preferably provided with additional clearance. For a better view, the stepped-down position of the sole holder 8 was illustrated in FIG. 1 by a dashed line showing only the mandrel 8*b* in this position.

The distance or clearance h thus extends the effective height of the two approximately vertical surfaces 7*a*, 7*b* which create the blocking recess for the heel holder 1, which blocking recess is effective against purely lateral release forces. The concept of blocking the heel holder 1 against purely lateral forces and permitting the release operation in such cases to occur exclusively by means of the front jaw is known by itself from Austrian Pat. No. 305 843 (corresponds to U.S. Pat. No. 3,876,219). On the one hand it is thereby supposed to be assured that the roller efficiently and deeply sits in the blocking recess of the control surface 7, and on the other hand that after horizontal blocking during a predetermined amount of upward movement of the sole holder in response to the action of so-called diagonal forces, which forces simultaneously act in the horizontal and vertical directions, a horizontal release of the heel holder 1 is allowed to occur. Since the height of the blocking recess is determined by the dimensions of the roller and such rollers for reasons of construction are usable only with limited dimensions, it has been a problem for a long period of time to increase the effective height of the blocking recess without increasing the dimensions of the roller.

The above-disclosed resilient support of the roller 9 solves this problem without requiring any dimensions to be increased. Also, the stability of the entire system is thereby maintained, because without the creation of forces which act in the vertical direction the blocking path between the locking member 6 which is arranged on the ski, the roller 9, its axle 10 and the sole holder 8 is continued or effectively extended.

If now the force which is applied by the ski boot of the skier to the down-holding member 8*a* of the sole holder 8 overcomes the down-holding force of the not illustrated and conventional release mechanism and spring, then the sole holder 8 and thus also the housing 5 move further upwardly away from the upper side of the ski 2*a*, whereby now the axle 10 and the roller 9 are also lifted upwardly away from the support 12. The roller 9 thereby leaves the blocking recess which, as previously described in detail, is formed by the two vertical surfaces 7*a*, 7*b* of the control surface 7, so that in the further sequence a release of the heel holder 1 can occur even when forces which act simultaneously in the horizontal and vertical directions occur. These so-called diagonal forces are used by the inventive heel holder, similar to the solution described in Austrian Pat. No. 305 843, for the controlled release of the ski boot. For the purpose of avoiding repetition, reference is made to the release operation described in Austrian Pat. No. 305 843 (corresponds to U.S. Pat. No. 3,876,219). The details which are described in the Austrian patent are, except for the inventive development of the resilient support of the roller, also true for the exemplary embodiment according to FIGS. 1 to 3.

FIG. 3 serves only to illustrate the relative position between the roller 9 and the support 12 of the locking member 6 and between the axle 10 and the two guideways 8*b*, 5*a* (of which only the guideway 5*a* is indicated here with dashed lines) which corresponds to the position of the mandrel 8*b* illustrated in broken lines in FIG. 1. It can furthermore be recognized that the two springs 13, 14 have experienced an increase in their initial tension.

Figure 4:
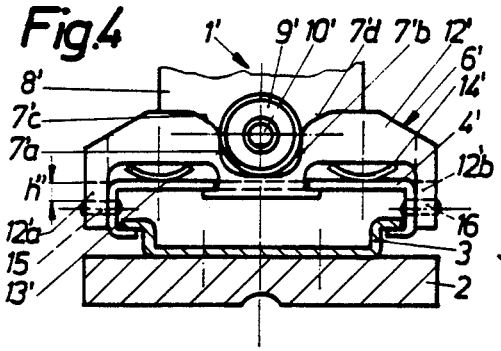
FIG. 4 is a sectional view similar to FIG. 2 of a further embodiment of the inventive heel holder in which a locking element on the sole holder is cooperable with a resiliently supported locking member.
Figure 5:
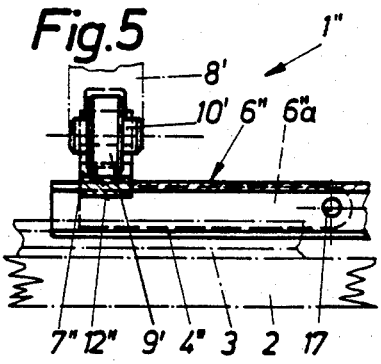
FIG. 5 is a sectional side view of a further embodiment of the inventive heel holder in which a locking element on the sole holder cooperates with a resiliently supported locking member.
Figure 6:
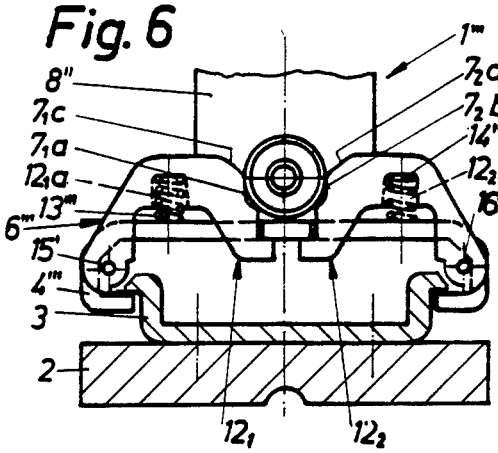
FIG. 6 is a sectional view similar to FIG. 2 of a further embodiment of the inventive heel holder in which a resiliently supported locking member is arranged on the ski.

The exemplary embodiments according to FIGS. 4, 5 and 6 illustrate three further possibilities of the inventive resilient support. In these three exemplary embodiments the roller 9' is supported vertically stationarily on the sole holder 8' by means of its axle 10' and is supported rotationally movably on the axle 10'. The resilient support is of the respective locking member 6', 6'' and 6'''. The following description is thereby directed in all cases to the development and function of the inventive resilient support.

In the exemplary embodiment according to FIG. 4, the locking member 6' is formed by a support 12' which is vertically movably supported on the base plate 4' of the heel holder 1' with the interpositioning of two springs 13', 14'. In the present exemplary embodiment, the two springs 13', 14' are leaf springs which are designed with upwardly pointing free ends, but these springs could of course also be arranged in a position with downwardly pointing free ends on the base plate 4'. The leaf springs 13', 14' are already initially tensioned in the illustrated position. The support 12' has on both sides downwardly extending legs which have guideways 12'*a*, 12'*b* which are constructed as vertical slots. Pins 15, 16 respectively engage the individual guideways 12'*a*, 12'*b* of the support 12', which pins are secured to the two side surfaces of the base plate 4'. In order to avoid a tilting of the support 12' relative to the base plate 4', similar guideways and pins, viewed in the longitudinal direction of the ski, can be provided at a distance from the described guideways. The region of the support 12' has a height which does not in any manner hinder an operation of the heel holder 1'. The support 12' is thus designed as a type of spring biased slide member movable relative to the base plate 4'. With respect to the design of the control surface 7', particularly its vertical surfaces 7'*a*, 7'*b* and its inclined surfaces 7'*c*, 7'*d*, reference is made to the description according to FIGS. 1 to 3.

The position of the roller 9' which is illustrated in FIG. 4 corresponds with the position of roller 9 in FIGS. 1 and 2. Thus, a distance h'' can be recognized here, too, which is overcome during the closing of the heel holder 1'. In this case, however, the two leaf springs 13', 14' lie between the underside of the support 12' and the upper side of the base plate 4', so that the distance h'' must be relatively large, in order to be able to achieve an action during closing of the heel holder 1' similar to that according to the first exemplary embodiment. The operation and all further comments which have been made in connection with the first exemplary embodiment are also valid for this exemplary embodiment.

In the exemplary embodiment according to FIG. 5, the locking member 6'' is designed as an apprpximately U-shaped member in the top view, the web or bight of which serves as the support 12'' and the two legs 6''*a*, 6''*b* of which are each supported pivotally on a respective swivel bolt 17 which is secured to the base plate 4''. FIG. 5 shows only one leg 6'' a and the associated swivel bolt 17. Thus, the support 12'' in the present case moves as a swiveling member, but the practical difference between a movement in the vertical plane according to the exemplary embodiment of FIG. 4 and the swiveling movement according to the exemplary embodiment of FIG. 5 is reduced as the distance between the support 12'' and the two swivel bolts 17 increases. Since this distance, due to structural considerations is likely to be limited, and since it is desirable that the control surface 7'', in each position of the heel holder 1'', engage the control surface 7'' along a line rather than a point, it can be advantageous to design the control surface with an upper side which has an incline or twist relative to the base plate 4'', whereby the inclination or twist is determined precisely by the aforementioned distance between the support 12'' and the swivel bolts 17. The determining of the inclination or twist lies within the knowledge of a person skilled in the art.

The operation and all further comments which have been made in connection with the preceding embodiment are also valid for this exemplary embodiment.

In the exemplary embodiment according to FIG. 6, the modification, in comparison to the exemplary embodiments according to FIGS. 4 and 5, is that in place of a single support, two support parts $12_1$, $12_2$ are provided. Accordingly, here the control surface 7''' is formed by separate vertical surfaces $7_1a$, $7_2b$ and inclined cam surfaces $7_1c$, $7_2d$. The two support parts $12_1$, $12_2$ are in this case, with the interpositioning of two compression springs 13''', 14''', supported on the upper side of the base plate 4'''. Furthermore, the two support parts $12_1$, $12_2$ are each supported pivotally about a respective pin, bolt or the like 15', 16'. The two pins 15', 16' are secured in the base plate 4''' of the heel holder 1', and for example are each riveted in a respective sheet metal wall which is bent out of the material of the base plate 4''' and is not illustrated separately. For receiving ends of the two compression springs 13''', 14''' the two support parts $12_1$, $12_2$ each have a recess which is a blind opening or guideway $12_1a$, $12_2b$.

The position which is illustrated in FIG. 6 corresponds with the position according to FIG. 4 or according to FIG. 2, so that a further description of the design and the function of this embodiment should not be necessary. It is only remarked that, assuming corresponding dimensions, the effective blocking recess height can be increased in comparison with the aforedescribed embodiments, due to the swiveling of the two support parts $12_1$, $12_2$ in comparison to relative movement which takes place exclusively in the vertical direction.

The operation and all further comments which were made in connection with the exemplary embodiments according to FIGS. 4 and 5 are also valid for the heel holder 1''' according to this exemplary embodiment.

The invention is not limited to the illustrated exemplary embodiments. Further modifications are conceivable, including the rearrangement or reversal of parts, which by all means lie within the scope of the invention. For example, in the first exemplary embodiment according to FIGS. 1 to 3, the resilient support could occur through two springs which extend in the free space on the underside of the sole holder. Or one could use a single spring which is supported in this region. In place of leaf springs or compression springs, it would also be possible to use cup springs or spring disks. One could replace the metallic spring material with a different resilient material, for example with rubber.

Furthermore, one can also create a further developed resilient support, in that not only one of the roller or the support or support parts is resiliently supported, but both the roller and the support or support parts are resiliently supported. In particular, this could be implemented in the exemplary embodiment according to FIG. 6, whereby then through the design of the springs which support the roller and the springs which support the two support parts the control distance can be utilized selectively as in the described exemplary embodiments or can be used in the following briefly described manner. If namely the force of the two springs which support the individual support parts is greater than the force of those springs which urge the roller downwardly, then there occurs first a moving up of the roller in the two guideways and only then are the two support parts pressed downwardly against the force of the springs which bias them. If, however, the force of the compression springs for the support parts is smaller, then first a pressing down of the two support parts occurs and only upon a complete pressing down of the heel holder is the roller pressed upwardly against the force of the two springs which bias it. No special discussion is needed to make it clear that in both cases the effective height of the blocking recess is increased by the sum of the two control distances involved.

Similar combinations can also be realized between the other exemplary embodiments, independent from which type of spring action is used.

The embodiments of the invention in which an exclusive property or privilege is claimed are defined as follows:

1. A heel holder comprising: a base mountable on a ski; a sole holder which is supported on said base for substantially vertical movement relative thereto between a closed position adjacent said base and an open position spaced from said base and which is supported for horizontal movement relative to said base in directions transverse to the ski; first locking means for yieldably resisting upward movement of said sole holder away from said closed position; and second locking means for resisting transverse horizontal movement of said sole holder relative to said base until said sole holder has moved upwardly a predetermined distance away from said closed position, said second locking means including a first locking part supported on one of said base and said sole holder, a second locking part supported on the other of said base and sole holder for generally vertical movement relative thereto toward and away from said first locking part, means for limiting movement of said second locking part toward said first locking part relative to said other of said base and sole holder past a first position, and resilient means for yieldably urging said second locking part toward said first position thereof, wherein said second locking means includes one of said first and second locking parts having a substantially vertically extending recess which opens toward and receives the other of said locking parts when said sole holder is in said closed position, said first locking part moving said second locking part relative to said other of said base and sole holder against the urging of said resilient means to a second position spaced a predetermined distance from said first position as said sole holder is moved to said closed position, whereby said sole holder must move upwardly said predetermined distance before said first and second locking parts move vertically relative to each other.

2. The binding according to claim 1, wherein said second locking means includes said first locking part having said recess therein and said second locking part being provided on said sole holder, said second locking part including a cylindrical roller and a horizontal axle which supports said roller and has its ends vertically movably supported in two vertical slots provided in spaced vertical walls of said sole holder, said resilient means including a spring which is supported on said sole holder, engages said axle, and urges said axle toward the lower ends of said slots.

3. The binding according to claim 2, wherein said sole holder has means defining a downwardly open recess in an underside thereof, said spaced walls being located in and said roller being substantially disposed within said recess in said sole holder; and wherein said spring is a leaf spring having its ends supported on said sole holder and having a central portion which engages said axle.

4. The binding according to claim 2, wherein said recess is part of a cam surface provided on said first locking part and has approximately vertical side walls spaced by a distance approximately equal to the diameter of said roller, and wherein said recess has a depth at least as large as the radius of said roller.

5. The binding according to claim 1, wherein said second locking means includes said second locking part having said recess therein and being a support which is vertically movably supported on said base plate, said resilient means including a spring which is disposed between said base plate and said support and urges said support upwardly.

6. The binding according to claim 5, wherein said support is generally U-shaped and a downwardly extending leg at each side thereof, each said leg having a vertical slot therein, wherein said resilient means includes two said springs which are leaf springs, and wherein said base plate has on each side thereof a laterally outwardly projecting retainer pin which is slidably received in said slot in a respective said leg of said support.

7. The binding according to claim 5, wherein said first locking part includes a cylindrical roller supported on said sole holder for rotation about a horizontal axis, wherein said recess is part of a cam surface provided on said second locking part and has approximately vertical side walls which are spaced by a distance approximately equal to the diameter of said roller, and wherein said recess has a depth at least as large as the radius of said roller.

8. The binding according to claim 1, wherein said second locking means includes said second locking part having said recess therein, being supported on said base plate, and being an approximately U-shaped member in a top view, said U-shaped member having a web which has said recess therein and is movable generally vertically and having two legs which are each pivotally supported on a respective swivel bolt secured to said base plate at a location spaced from said web in a direction longitudinally of the ski.

9. The binding according to claim 1, wherein said second locking means includes said second locking part being provided on said base plate and having said recess therein, said second locking part including first and second support parts having first ends which are adjacent and having means on said first ends defining said recess, said support parts each having means defining a downwardly open blind bore therein; wherein said resilient means includes two helical springs which each have one end disposed in a respective said blind bore and the other end supported on an upper side of said base plate; and wherein said base plate has two pins thereon which are arranged symmetrically with respect to the longitudinal axis of the ski, which extend longitudinally of the ski, and which are each supported on a respective side wall of said base plate, said support parts each having a second end which is remote from said first end thereof and is pivotally supported on a respective said pin.

10. A ski binding, comprising a sole holder which is supported on a support member for movement in a generally vertical direction and has a first locking element which can engage a first locking member which is a swingably supported cam, said support member being supported for movement in a direction which is approximately perpendicular to said direction of movement of said sole holder, wherein said sole holder has a second locking element which is circular and engages a second locking member which has a cam surface and is supported on the ski, said cam surface on said second locking member having in its center a recess with vertical side surfaces which are spaced from one another by a distance approximately equal to the diameter of said second locking element, the depth of said recess being greater than or equal to the radius of said second locking element, wherein said second locking element which is provided on said sole holder and said second locking member which is provided on the ski are supported resiliently relative to one another, and wherein said second locking element is a roller which is supported on an axle which in turn is supported in said sole holder in two slotted holes which extend in the vertical direction and is urged to move vertically relative to said sole holder by a spring which is supported in said sole holder.

11. The binding according to claim 10, wherein said axle of said roller, in an open position of said sole holder, is positioned at the lower ends of said slotted holes and, in a closed condition of said sole holder, is maintained against the force of said spring in upper portions of said slotted holes.

* * * * *